US009987741B2

(12) United States Patent
Evatt et al.

(10) Patent No.: US 9,987,741 B2
(45) Date of Patent: Jun. 5, 2018

(54) TOOL BIT CASE

(71) Applicant: Techtronic Industries Co. Ltd., Tsuen Wan, New Territories (HK)

(72) Inventors: Thomas Evatt, Six Mile, SC (US); James Mays, Flint, MI (US)

(73) Assignee: TECHTRONIC INDUSTRIES CO. LTD., Tsuen Wan, New Territories (HK)

( * ) Notice: Subject to any disclaimer, the term of this patent is extended or adjusted under 35 U.S.C. 154(b) by 64 days.

(21) Appl. No.: 14/620,696

(22) Filed: Feb. 12, 2015

(65) Prior Publication Data

US 2016/0236342 A1 Aug. 18, 2016

(51) Int. Cl.
*B65D 85/00* (2006.01)
*B25H 3/00* (2006.01)

(52) U.S. Cl.
CPC ..... *B25H 3/003* (2013.01)

(58) Field of Classification Search
CPC . B25H 3/003; B25H 3/02; B25H 3/00; B25H 3/025; B25H 3/023; B25H 3/022; B25H 3/021; B65D 85/00
USPC ..... 206/379, 372, 373, 234, 349, 377, 378
See application file for complete search history.

(56) References Cited

U.S. PATENT DOCUMENTS

| | | | | |
|---|---|---|---|---|
| 350,016 | A | 9/1886 | Richards | |
| 1,822,070 | A | 9/1931 | Vallone | |
| 4,958,732 | A | 9/1990 | Rau et al. | |
| 5,595,294 | A * | 1/1997 | McKenzie | B25H 3/021 206/349 |
| 5,829,596 | A | 11/1998 | Budert | |
| 6,193,200 | B1 | 2/2001 | Kao | |
| 6,615,983 | B1 * | 9/2003 | Yu | B25H 3/003 206/372 |
| 6,679,379 | B1 | 1/2004 | Kao | |
| 6,719,154 | B2 | 4/2004 | Kao | |
| 6,732,989 | B1 | 5/2004 | Kao | |
| 6,857,527 | B2 | 2/2005 | Hu | |
| 7,584,845 | B2 | 9/2009 | Cheng | |
| 8,047,386 | B2 | 11/2011 | Chen | |
| 8,276,767 | B2 | 10/2012 | Su | |
| 2001/0008215 | A1 | 7/2001 | Colombo | |
| 2005/0155883 | A1 | 7/2005 | Edamura | |
| 2005/0178686 | A1 * | 8/2005 | Pangerc | B25H 3/003 206/379 |

(Continued)

FOREIGN PATENT DOCUMENTS

| | | |
|---|---|---|
| CN | 2336930 | 9/1999 |
| CN | 201405341 | 2/2010 |

(Continued)

*Primary Examiner* — Rafael Ortiz
(74) *Attorney, Agent, or Firm* — Michael Best & Friedrich LLP

(57) ABSTRACT

A tool bit case includes a housing and a tool bit retainer pivotally coupled to the housing. The tool bit retainer includes a retainer housing having a plurality of tool bit apertures configured to receive a plurality of tool bits, and a locking mechanism moveably coupled to the retainer housing between a first position, in which the locking mechanism engages the plurality of tool bits to inhibit removal of the plurality of tool bits from the retainer housing, and a second position, in which the locking mechanism disengages the plurality of tool bits to allow removal of the plurality of tool bits from the retainer housing.

20 Claims, 16 Drawing Sheets

(56) References Cited

U.S. PATENT DOCUMENTS

2011/0174648 A1 7/2011 Huang et al.

FOREIGN PATENT DOCUMENTS

| | | |
|---|---|---|
| CN | 201455967 | 5/2010 |
| CN | 201457872 | 5/2010 |
| CN | 201545256 | 8/2010 |
| CN | 201816053 | 5/2011 |
| CN | 202507268 | 10/2012 |
| CN | 202668443 | 1/2013 |
| CN | 203427002 | 2/2014 |
| CN | 203438219 | 2/2014 |
| EP | 0440909 | 8/1991 |

* cited by examiner

TOOL BIT CASE

BACKGROUND

The present invention relates to storage devices and, more particularly, to cases for storing tool bits.

Containers for storing tool bits such as drill bits, impact screwdrivers, torque bits, and the like are known. These containers typically include different types of retainers to selectively hold the tool bits in place during transportation of the containers.

SUMMARY

In one embodiment, the invention provides a tool bit case including a housing and a tool bit retainer pivotally coupled to the housing. The tool bit retainer includes a retainer housing having a plurality of tool bit apertures configured to receive a plurality of tool bits, and a locking mechanism moveably coupled to the retainer housing between a first position, in which the locking mechanism engages the plurality of tool bits to inhibit removal of the plurality of tool bits from the retainer housing, and a second position, in which the locking mechanism disengages the plurality of tool bits to allow removal of the plurality of tool bits from the retainer housing.

In another embodiment, the invention provides a tool bit case including a first housing member and a second housing member pivotally coupled together about an axis. The tool bit case also includes a plurality of tool bit retainers pivotally coupled between the first and second housing members about the axis. Each tool bit retainer includes a retainer housing having a plurality of tool bit apertures configured to receive a plurality of tool bits, and a locking mechanism moveably coupled to the retainer housing between a first position, in which the locking mechanism engages the plurality of tool bits to inhibit removal of the plurality of tool bits from the retainer housing, and a second position, in which the locking mechanism disengages the plurality of tool bits to allow removal of the plurality of tool bits from the retainer housing.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
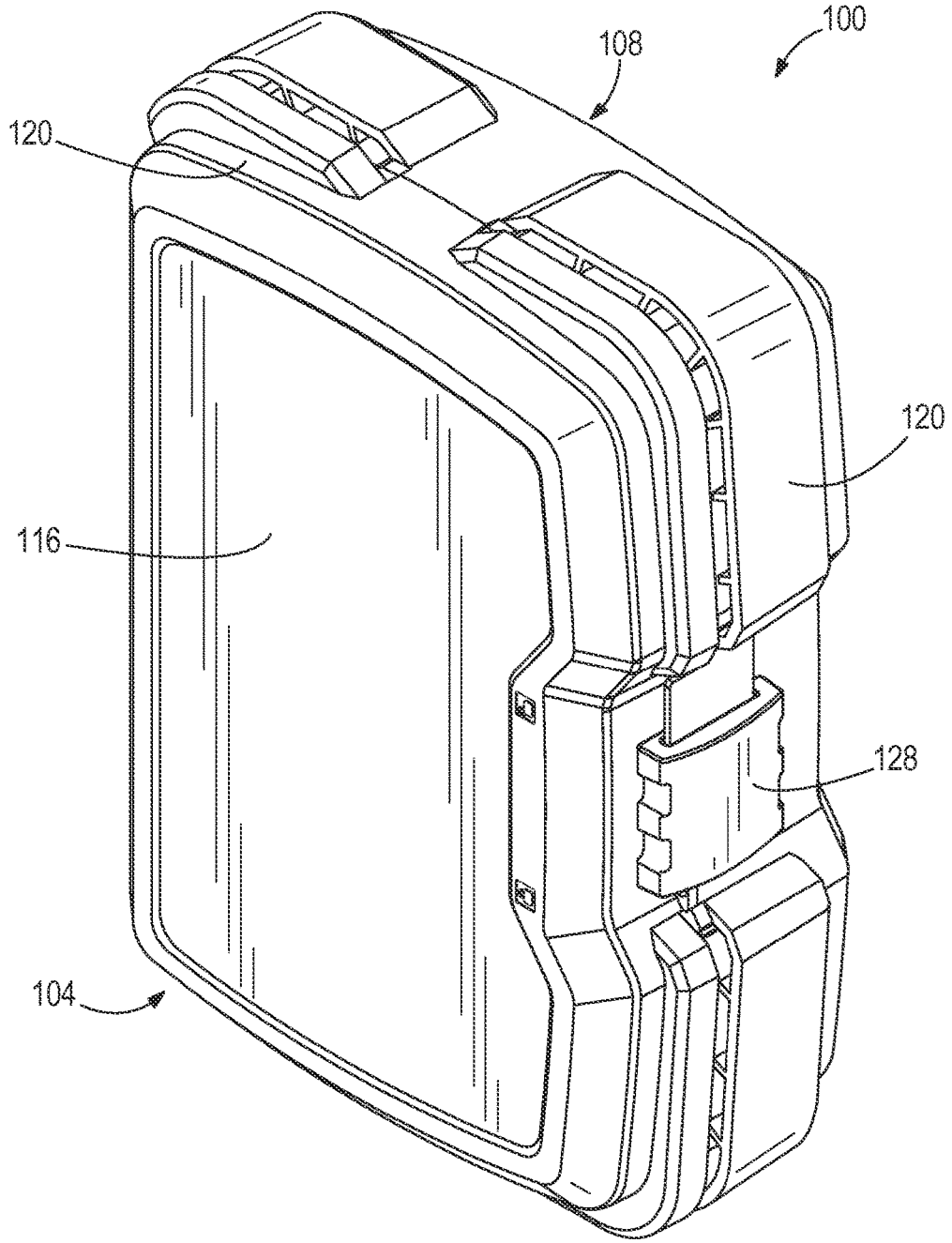
FIG. 1 is a perspective view of a tool bit case according to one embodiment of the invention, the tool bit case being in a closed position.
Figure 2:
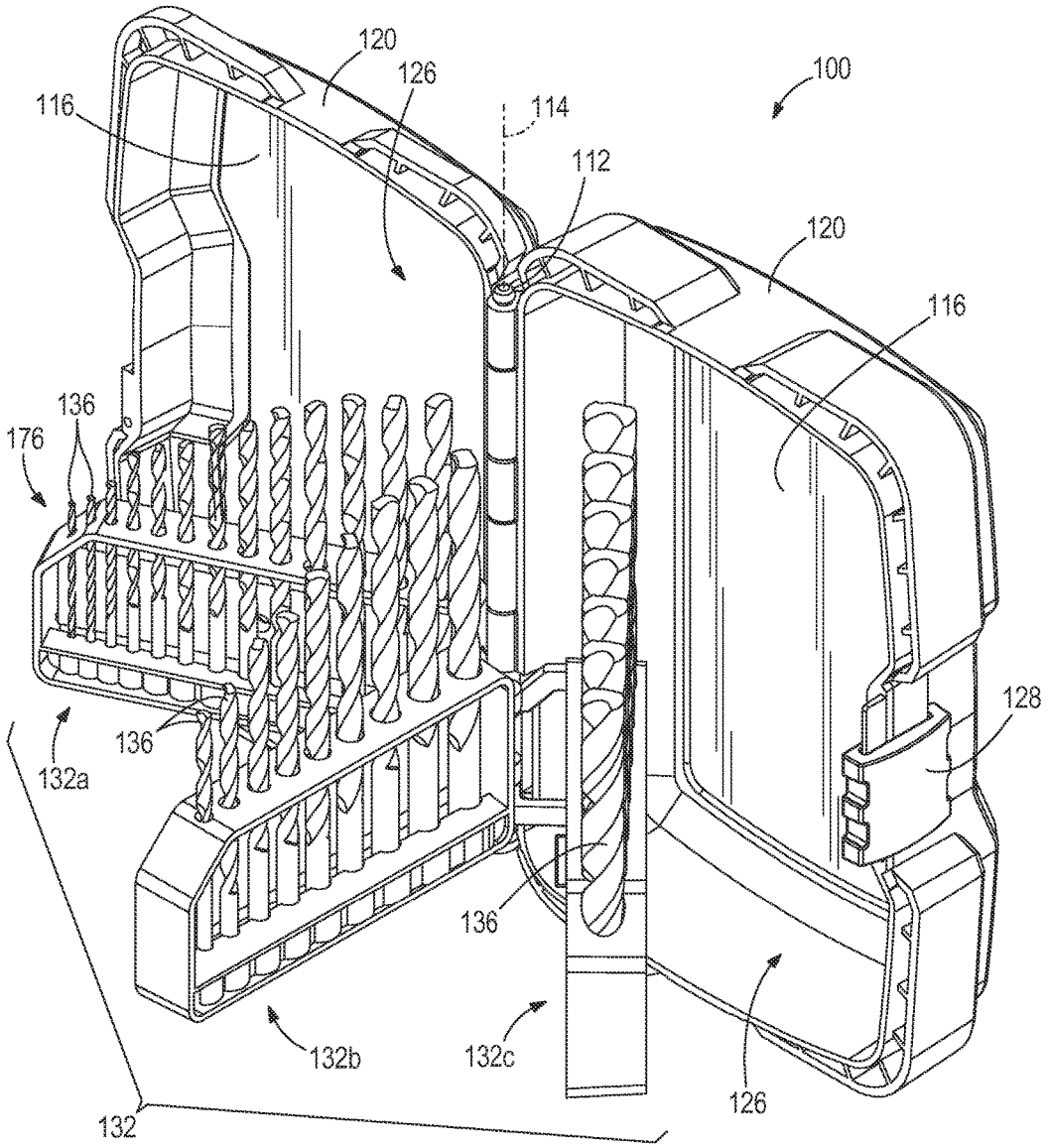
FIG. 2 is a perspective view of the tool bit case in an open position, the tool bit case including tool bit retainers.
Figure 3:
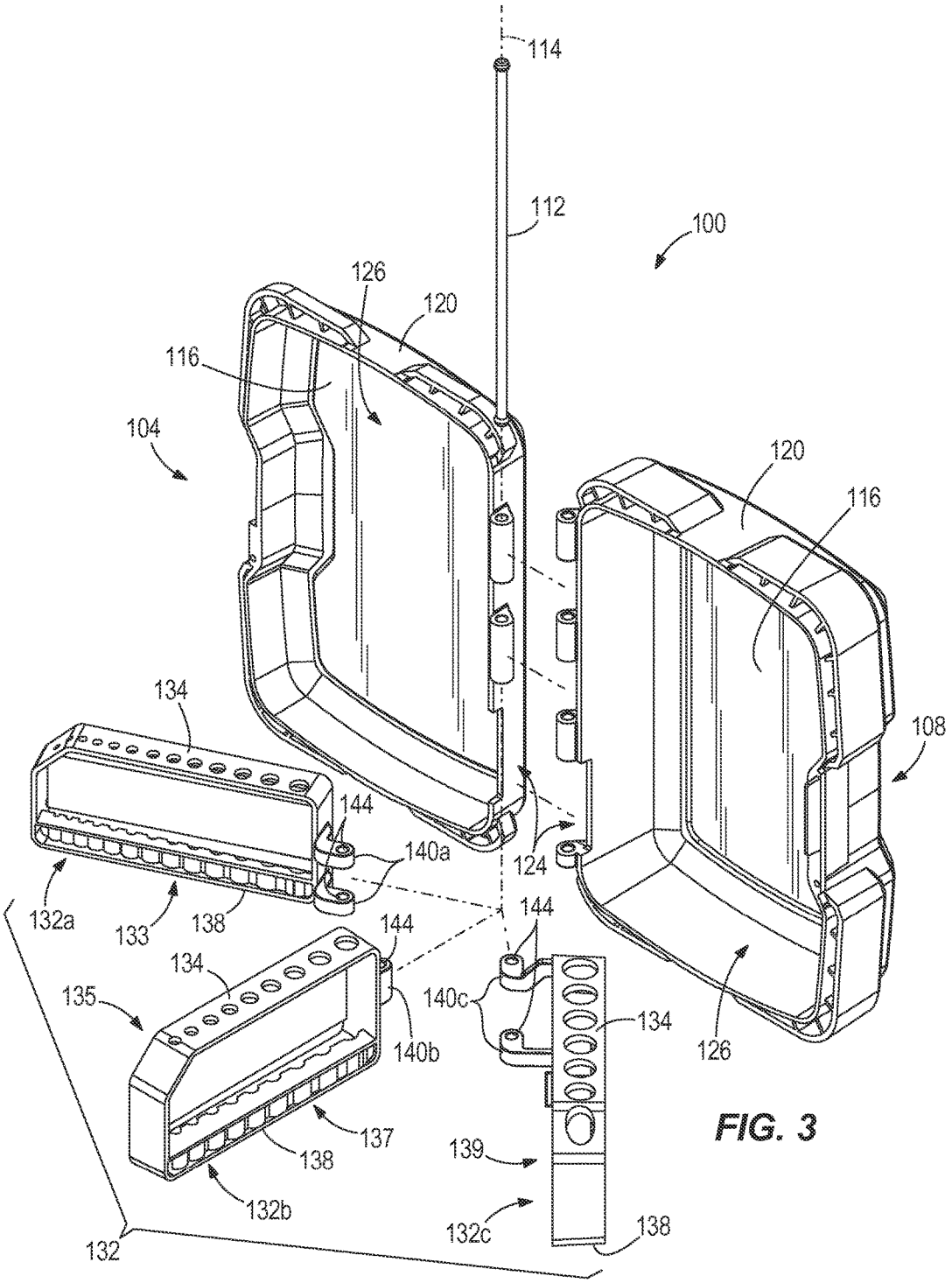
FIG. 3 is an exploded perspective view of the tool bit case.

FIGS. 1-5 illustrate a tool bit case 100 configured to hold and store tool bits. The illustrated case 100 includes two housing members 104, 108 pivotally coupled together by a pin 112. The pin 112 defines a longitudinal axis 114. In the illustrated embodiment, the first housing member 104 is a front cover, and the second housing member 108 is a rear cover. As shown in FIG. 2, each of the front cover 104 and the rear cover 108 includes a base 116 and sidewalls 120 that extend from a periphery of the base 116. In the illustrated embodiment, the sidewalls 120 are substantially perpendicular to the base 116. As shown in FIG. 3, notches 124 are formed in sections of the sidewalls 120 where the covers 104, 108 are connected together. The notches 124 of the covers 104, 108 are sized to align with each other. In addition, the sidewalls 120 are not equal in size (i.e., height or depth). For example, the sidewall 120 of the rear cover 108 is taller (or deeper) than the sidewall 120 of the front cover 104. The bases 116 and the sidewalls 120 define a storage cavity 126 of the tool bit case 100.

Furthermore, the front and the rear covers 104, 108 are movable (e.g., pivotable) between a closed position (FIG. 1) and an open position (FIG. 2). When the covers 104, 108 are in the closed position, the storage cavity 126 is inaccessible. When the covers 104, 108 are in the open position, the storage cavity 126 is accessible. The covers 104, 108 are lockable in the closed position by a latch mechanism 128. In the illustrated embodiment, the latch mechanism 128 slides relative to the covers 104, 108 between a locked position and an unlocked position. When the latch mechanism 128 is in the locked position, the latch mechanism 128 engages both covers 104, 108 (while the covers 104, 108 are in the closed position) so that the covers 104, 108 cannot be opened. When the latch mechanism 128 is in the unlocked position, the latch mechanism 128 only engages one cover so that the covers 104, 108 can move to the open position. In other embodiments, the latch mechanism 128 may pivot or rotate between the locked and unlocked positions.

As illustrated in FIG. 2, the tool bit case 100 includes tool bit retainers 132. The retainers 132 retain and organize multiple sizes of tool bits 136 and are located within the storage cavity 126 when the tool bit case 100 is in the closed position. The illustrated tool bits 136 are twist drill bits; however, in other embodiments, the drill bits 136 may be auger bits, screw driver bits, and the like. In the illustrated embodiment, the tool bit case 100 includes three tool bit retainers 132*a*, 132*b*, 132*c* that selectively receive various sizes of drill bits 136. The first tool bit retainer 132*a* receives relatively smaller sized drill bits 136, the second tool bit retainer 132*b* receives relatively medium sized drill bits 136, and the third tool bit retainer 132*c* receives relatively larger sized drill bits 136. In other embodiments, the tool bit case 100 may include fewer or more than three tool bit retainers 132. Each tool bit retainer 132 receives a series of drill bits 136 that incrementally increase in size (e.g., diameter). For example, the tool bit retainers 132 receive drill bits 136 having diameters between 1/16" to 1/2" and incrementing in diameter by 1/64", resulting in a 29-piece drill bit set. In other embodiments, the tool bit retainers 132 may receive fewer or more than 29 drill bits, and/or the drill bits 136 may increment in sizes other than by 1/64" in diameter.

Figure 5:
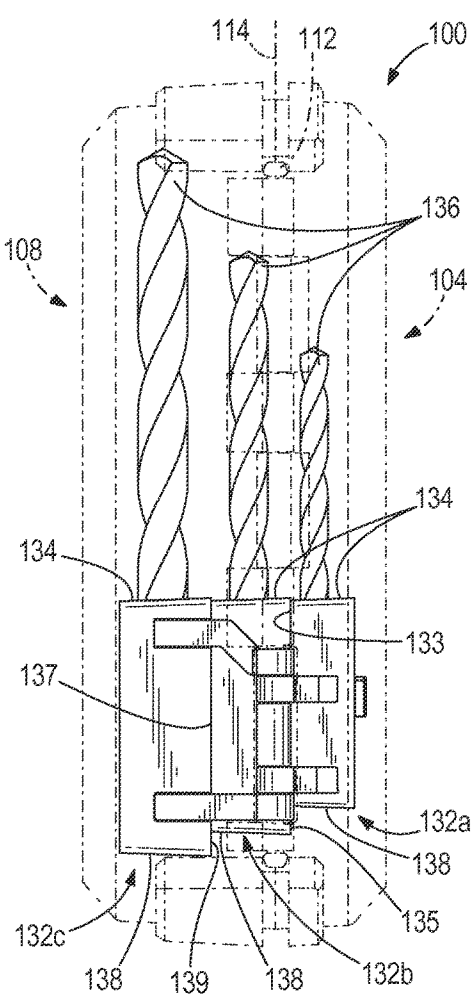
FIG. 5 is a side, partially transparent view of the tool bit case.
Figure 4:
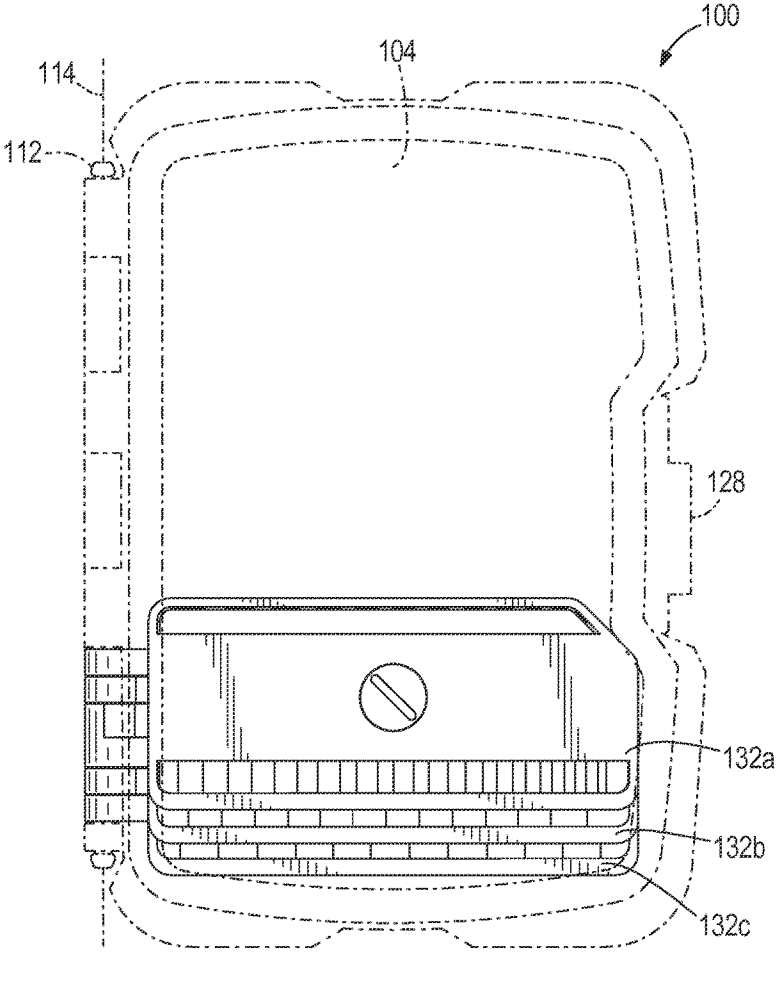
FIG. 4 is a front, partially transparent view of the tool bit case.

With reference to FIGS. 4 and 5, heights of the tool bit retainers 132*a*, 132*b*, 132*c* are constructed such that lengths of the drill bits 136 received within the tool bit retainers 132*a*, 132*b*, 132*c* are different. For example, the first tool bit retainer 132*a* is shorter (measured along the longitudinal axis 114) than the second and third tool bit retainers 132*b*, 132*c*, while the second tool bit retainer 132*b* is shorter (measured along the longitudinal axis 114) than the third tool bit retainer 132*c*. As such, the portions of the drill bits 136 received within the first tool bit retainer 132*a* are shorter than the portions of the drill bits 136 received within the second tool bit retainer 132*b*. Likewise, the portions of the drill bits 136 received within the second tool bit retainer 132*b* are shorter than the portions of the drill bits 136 received within the third tool bit retainer 132*c*. In addition, upper surfaces 134 (i.e., surfaces from which the drill bits 136 extend out) of the tool bit retainers 132*a*, 132*b*, 132*c* generally align in a plane (FIG. 5). In contrast, lower surfaces 138 of the tool bit retainers 132*a*, 132*b*, and 132*c* are stepped.

In the illustrated embodiment, the tool bit retainers 132*a*, 132*b*, 132*c* pivot about a common axis (i.e., the longitudinal axis 114). Each tool bit retainer 132*a*, 132*b*, 132*c* includes a support, or hinge, structure 140 having a least one pin aperture 144. The illustrated support structures 140 are configured (e.g., shaped and sized) to fit within the notches 124 of the covers 104, 108 so that the support structures 140 create a relatively smooth and continuous spine with the covers 104, 108. The pin apertures 144 are sized to receive the pin 112 (FIG. 3). The support structures 140*a*, 140*b*, 140*c* are coupled to the pin 112 between the covers 104, 108 so that a portion (e.g., a rear surface 133) of the first tool bit retainer 132*a* abuts a portion (e.g., a front surface 135) of the second tool bit retainer 132*b*, and a portion (e.g., a rear surface 137) of the second tool bit retainer 132*b* abuts a portion (e.g., a front surface 139) of the third tool bit retainer 132*c*.

FIGS. 6-10 illustrate a first embodiment of the tool bit retainer 132. Within FIGS. 6-10, the first tool bit retainer 132*a* is illustrated; however, features and components of the first tool bit retainer 132*a* are the same as the second and third tool bit retainers 132*b*, 132*c*. Therefore, only the first tool bit retainer 132*a* will be discussed in detail below, and will be identified as "tool bit retainer 132."

Figure 6:
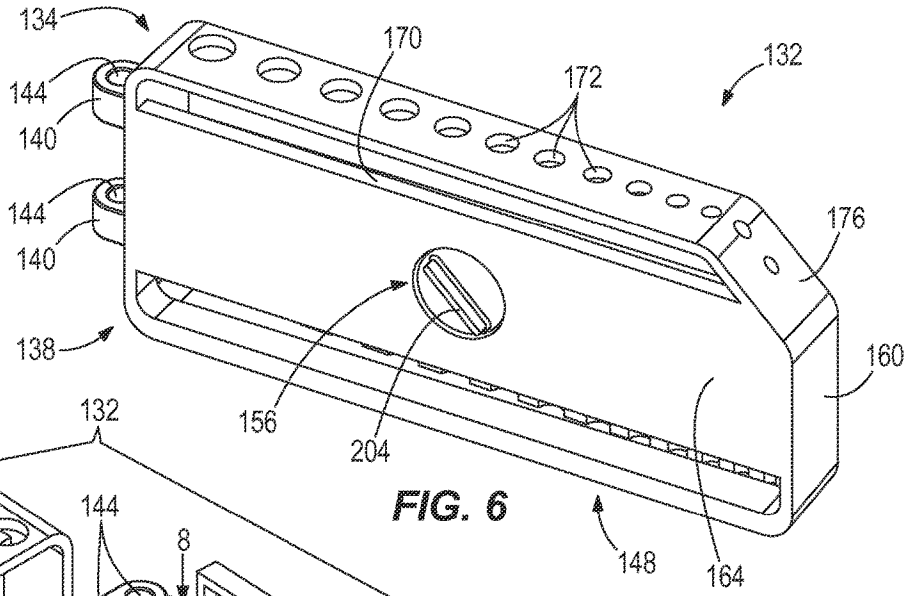
FIG. 6 is a perspective view of a tool bit retainer for use with the tool bit case.
Figure 7:
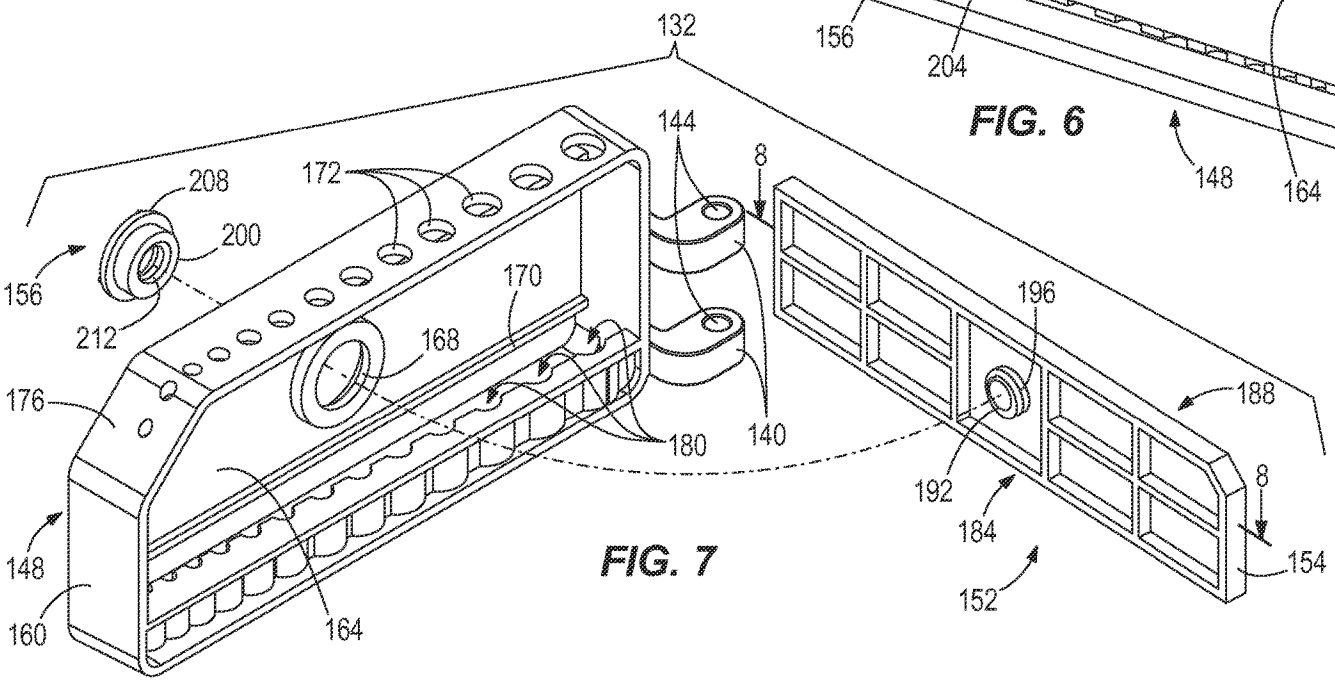
FIG. 7 is an exploded perspective view of the tool bit retainer of FIG. 6.

The tool bit retainer 132 includes a housing 148, a locking mechanism 152, and an actuator 156. The housing 148 is defined by a frame 160 and a front face 164. The frame 160 is substantially defined by a strip of material, where the front face 164 extends between two opposing sides of the frame 160. In the illustrated embodiment, the frame 160 and the front face 164 are integrally formed (e.g., molded) as a single piece, but may alternatively be formed as separate pieces that are secured together. The front face 164 includes a central aperture 168 and guides 170. The guides 170 extend along a top periphery and a bottom periphery of a rear portion of the front face 164 (FIGS. 6 and 7). In other embodiments, the guides 170 may extend along only one of the top periphery or the bottom periphery of the front face 164. On the upper surface 134 of the frame 160, drill bit apertures 172 are formed in a row. The apertures 172 are configured to receive the drill bits 136. A corner 176 of the housing 148 located away from the support structures 140 is chamfered. As shown in FIG. 2, the chamfered corner 176 provides a reduced distance between the upper surface 134 and the lower surface 138 to receive shorter drill bits 136. In the illustrated embodiment, the corner 176 includes two drill bit apertures 172; however, in other embodiments, the corner 176 may include more or less than two drill bit apertures 172. In further embodiments, the corner 176 may be omitted.

The housing 148 also includes cavities 180 located away from the drill bit apertures 172. In the illustrated embodiment, the cavities 180 are located adjacent the lower surface 138 of the frame 160. The illustrated cavities 180 are defined as semicircular grooves. In other embodiments, the cavities 180 may define circular apertures. Each cavity 180 is aligned with a corresponding drill bit aperture 172 so that a drill bit 136 extends through the aperture 172 and into the cavity 180. In addition, the size (e.g., radius) of each semicircular cavity 180 is generally the same as the size (e.g., radius) of the corresponding drill bit aperture 172.

Figure 8:
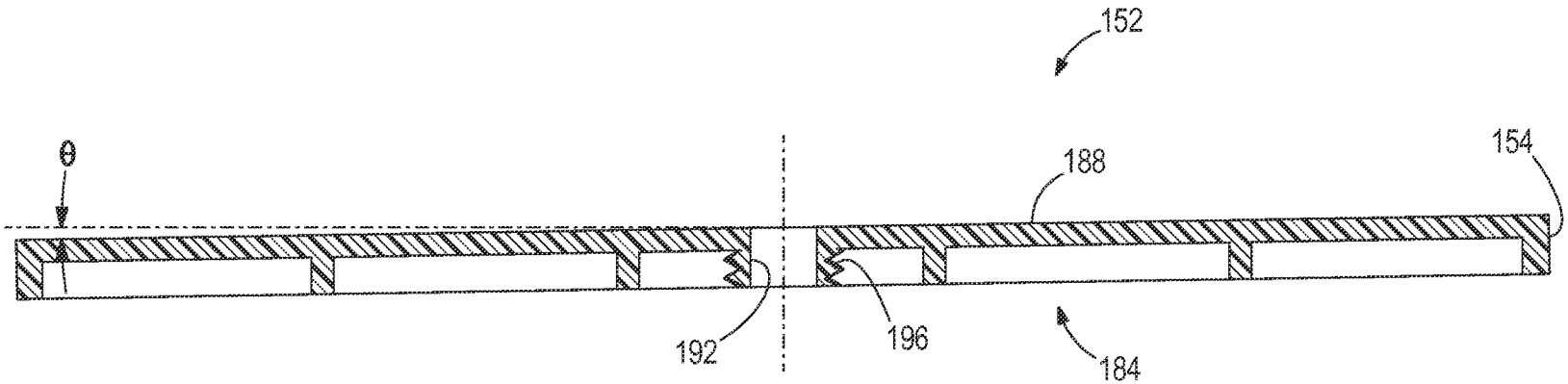
FIG. 8 is a cross-sectional view of a locking mechanism of the tool bit retainer taken along section line 8-8 of FIG. 7.
Figure 9:
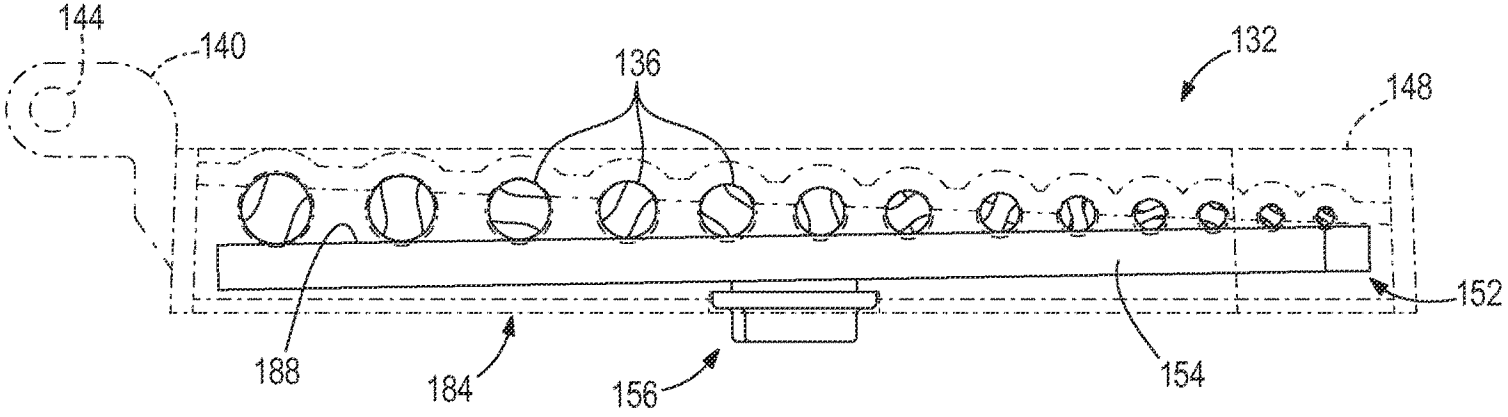
FIG. 9 is a top, partially transparent view of the tool bit retainer of FIG. 6 with the locking mechanism in a first position.

The locking mechanism 152 includes a plate 154 having a front portion 184, an engaging surface 188, and a protrusion 192. As shown in FIG. 8, the illustrated protrusion 192 is hollow and extends away from the engaging surface 188. The illustrated protrusion 192 extends at an oblique angle θ relative to a plane defined by the engaging surface 188. As shown in FIG. 9, the illustrated angle θ is selected such that the different sized (e.g., diameter) drill bits 136 are all generally evenly contacted by the engaging surface 188. In the illustrated embodiment, the angle θ is approximately one degree. In other embodiments, the angle may be larger or smaller, depending on the sizes (and size change increments) of the tool bits. Referring back to FIG. 8, external threads 196 are formed on the protrusion 192. In other embodiments, the threads 196 may be formed on an interior surface of the protrusion 192 (e.g., internal threads).

As shown in FIGS. 6 and 7, the actuator 156 is coupled to the locking mechanism 152. In the illustrated embodiment, the actuator 156 is a rotatable knob. The actuator 156 includes a projection 200 and a rib 204 coupled to a base 208. The rib 204 extends from one side of the base 208, and the projection 200 extends from the other side of the base 208. The illustrated projection 200 is defined as a hollow cylinder and includes internal threads 212. The threads 212 of the projection 200 engage the threads 196 on the protrusion 192 of the locking mechanism 152 to threadably connect the actuator 156 to the locking mechanism 152. In other embodiments, the threads 212 may be formed on an exterior surface of the projection 200 (e.g., external threads).

During assembly of the tool bit retainer 132, the front face 164 of the housing 148 is located between the actuator 156 and the locking mechanism 152, and the actuator 156 engages the locking mechanism 152. In particular, the locking mechanism 152 is located between the guides 170, and the protrusion 192 of the plate 154 is received within the central aperture 168 such that the front portion 184 of the plate 154 faces the front face 164 of the housing 148. Also, the projection 200 of the actuator 156 is received in the central aperture 168 of the housing 148. As a result, the internal threads 212 of the actuator 156 engage the external threads 196 of protrusion 192 of the locking mechanism 152. The drill bits 136 are received within the respective drill bit apertures 172 and the respective cavities 180.

Figure 10:
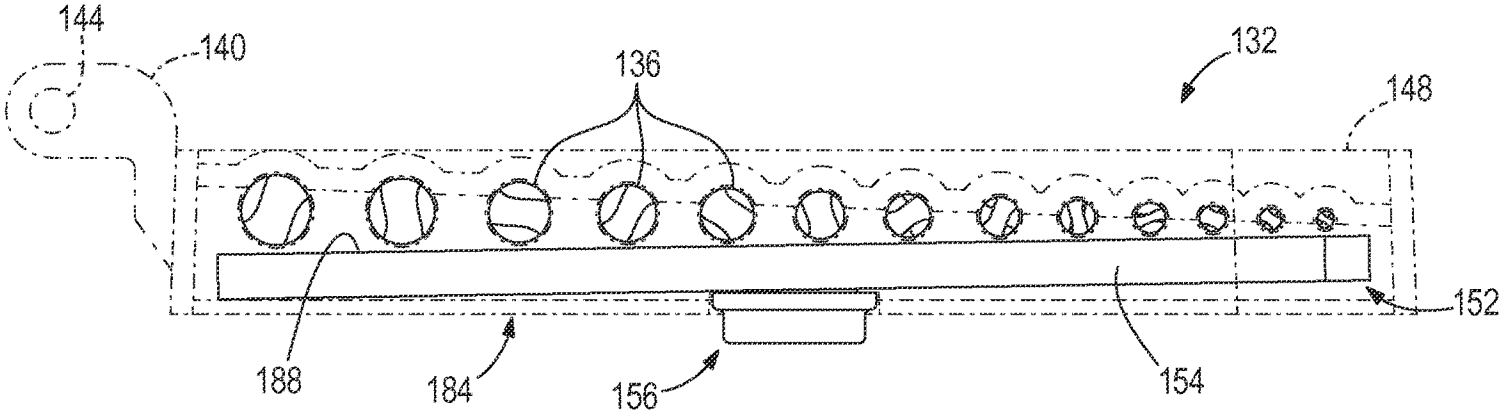
FIG. 10 is a top, partially transparent view of the tool bit retainer of FIG. 6 with the locking mechanism in a second position.
Figure 11:
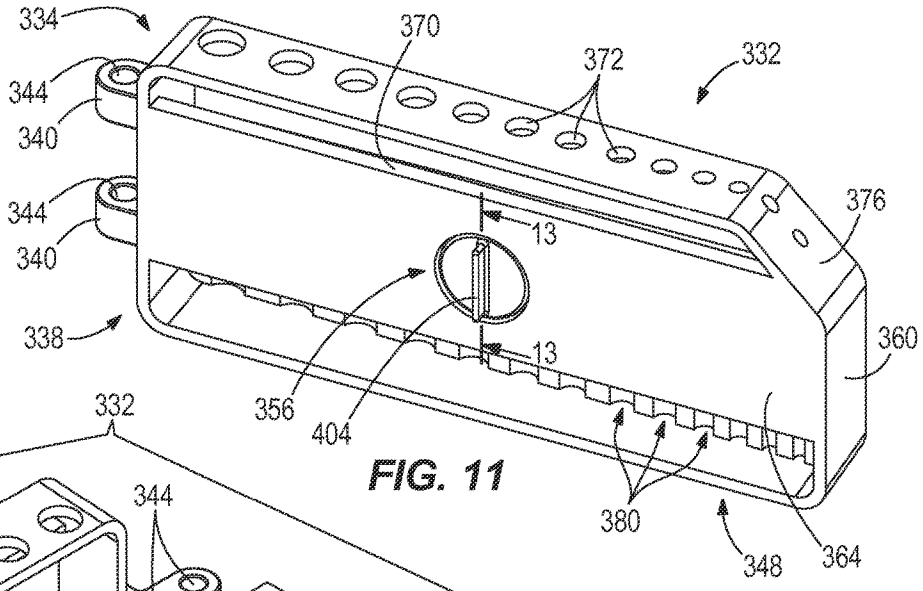
FIG. 11 is a perspective view of a tool bit retainer for use with the tool bit case according to another embodiment of the invention.

In operation, the locking mechanism 152 is movable between a first position (FIG. 9) and a second position (FIG. 10). In the first, or storage, position, the drill bits 136 are inhibited from being removed from the tool bit retainer 132. Particularly, once the actuator 156 is rotated (e.g., clockwise in FIG. 6), the locking mechanism 152 translates towards the drill bits 136 due to the threads 196, 212. In other words, the locking mechanism 152 moves away from the front face 164 of the housing 148. During this movement, the locking mechanism 152 is maintained between the guides 170 such that the locking mechanism 152 does not rotate relative to the housing 148. Consequently, the engaging surface 188 abuts (e.g., directly contacts) a portion of each drill bit 136, securing the drill bits 136 within the housing 148. Therefore, the drill bits 136 can be transported within the drill bit case 100 in an organized manner.

In the second, or removable, position, the drill bits 136 are removable from the tool bit retainer 132 such that the drill bits 136 can be used with a tool (e.g., a power drill). Particularly, as the actuator 156 is rotated (e.g., counter-clockwise in FIG. 6), the locking mechanism 152 translates away from the drill bits 136 due to the threads 196, 212. In other words, the locking mechanism 152 moves closer to the front face 164 of the housing 148. Consequently, the engaging surface 188 releases (e.g., moves apart from) the drill bits 136. Therefore, the drill bits 136 can be removed from the respective drill bit apertures 172 and cavities 180.

FIGS. 11-17 illustrate a tool bit retainer 332 according to another embodiment of the invention. The tool bit retainer 332 is similar to the tool bit retainer 132 discussed above; therefore, like components have been given like reference numbers plus 200. Only differences between the tool bit retainers 132 and 332 will be discussed in detail below. In addition, components or features described with respect to only one or some of the embodiments described herein are equally applicable to any other embodiments described herein.

The tool bit retainer 332 includes a housing 348, a locking mechanism 352, an actuator 356, and a spacer 216. The housing 348 is defined by a frame 360 and a front face 364 and has an upper surface 334 and a lower surface 338. The housing 348 includes a chamfered corner 376 and supports drill bits 336 via drill bit apertures 372 and cavities 380. The front face 364 includes a guide 370 (FIG. 11) and a rear protruding portion 214 having a central aperture 368. The rear protruding portion 214 extends away from the front face 364 toward the locking mechanism 352. Also, the guide 370 extends along a top periphery of a rear portion of the front face 364. Support structures 340 are located on a side of the housing 348 opposite from the corner 376.

The locking mechanism 352 includes a plate 354 having a front portion 384, an engaging surface 388, and a protrusion 392. The front portion 384 includes two recesses 220 adjacent the protrusion 392. The illustrated recesses 220 are formed on opposite sides of (e.g., above and below) the protrusion 392. In other embodiments, the locking mechanism 352 may only include one recess. In addition, the protrusion 392 includes a groove 224.

Figure 12:
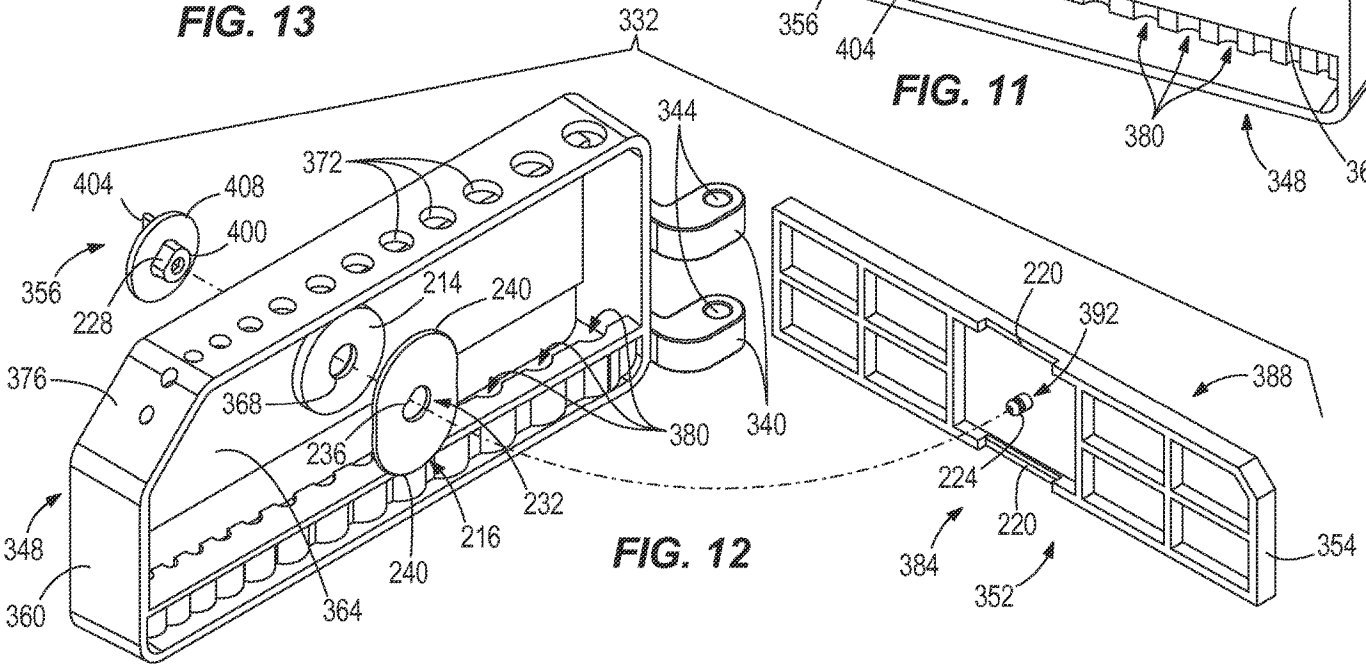
FIG. 12 an exploded perspective view of the tool bit retainer of FIG. 11.
Figure 13:
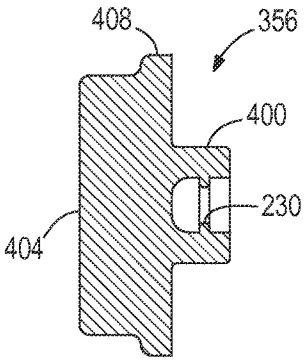
FIG. 13 is a cross-sectional view of an actuator of the tool bit retainer taken along section line 13-13 of FIG. 11.

With reference to FIG. 13, the actuator 356 includes a projection 400 and a rib 404 coupled to a base 408. A flat 228 (FIG. 12) is located on an outer surface of the projection 400. In addition, the projection 400 includes a recess having an annular protrusion 230. The recess and the annular protrusion 230 are constructed in similar geometry to the protrusion 392 and the groove 224 (e.g., positive and negative copies of each other).

Figure 15A:
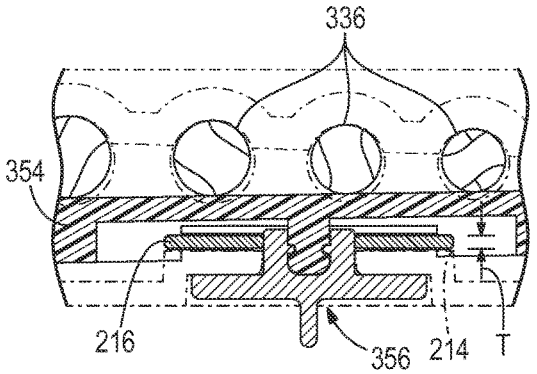
FIG. 15A is an enlarged cross-sectional view of a portion of the tool bit retainer taken along section line 15A-15A of FIG. 14.
Figure 14:
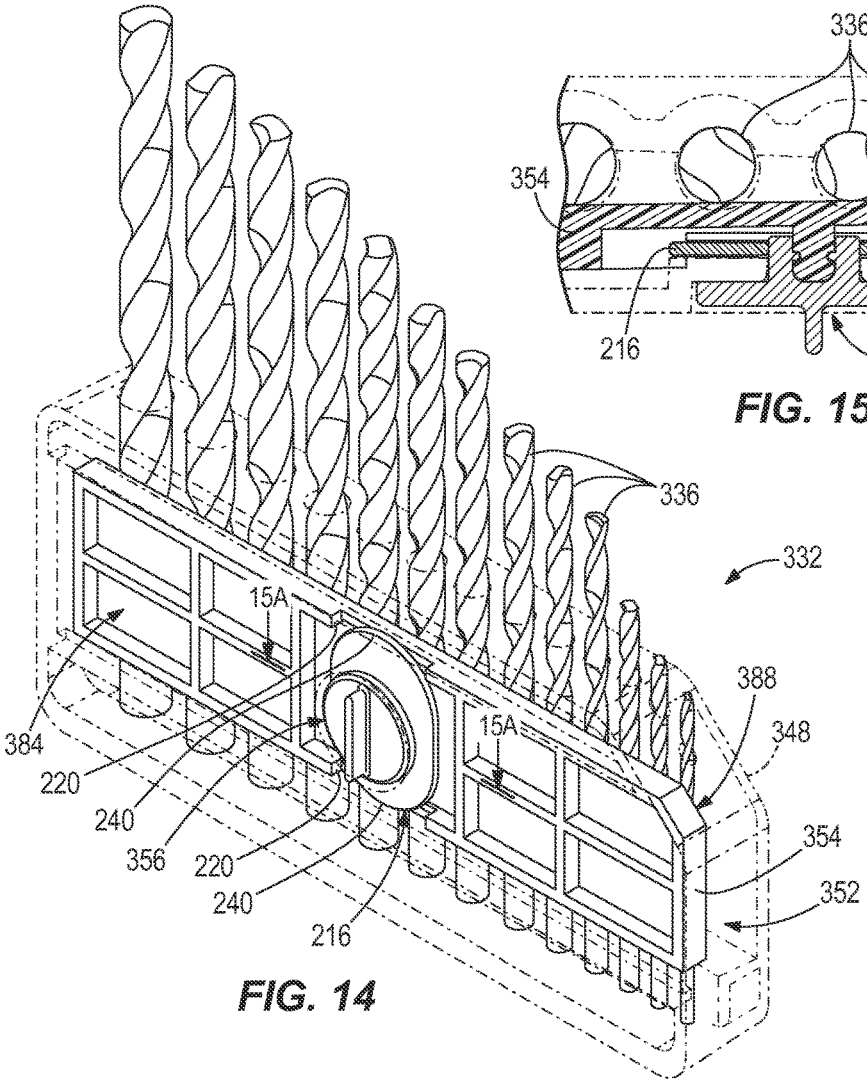
FIG. 14 is a perspective view of the tool bit retainer of FIG. 11 including a plurality of drill bits and a locking mechanism in a first position.
Figure 15:
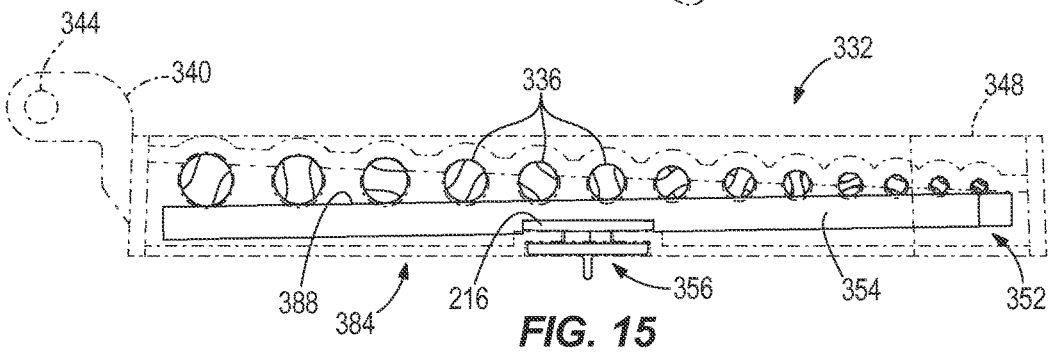
FIG. 15 is a top, partially transparent view of the tool bit retainer of FIG. 11 with the locking mechanism in the first position.

As shown in FIG. 12, the spacer 216 is a planar member located generally between the front face 364 of the housing 348 and the locking mechanism 352. In the illustrated embodiment, the spacer 216 is substantially constructed in the shape of an oval and includes an aperture 232 having a flat 236. The spacer 216 also includes edges 240 that define a curved periphery of the spacer 216. The illustrated spacer 216 includes a thickness T (FIG. 15A).

During assembly of the tool bit retainer 332, the actuator 356 engages the locking mechanism 352 with the spacer 216 located between the rear protruding portion 214 and the locking mechanism 352. Once the projection 400 of the actuator 356 is received within the central aperture 368, the spacer 216 is coupled to the projection 400 such that the flats 228, 236 align. Consequently, the actuator 356 and the spacer 216 are rotatably fixed together. Also, the groove 224 of the protrusion 392 engages the annular protrusion 230 of the actuator 356 such that the locking mechanism 352 is releasable secured to the actuator 356.

Figure 17A:
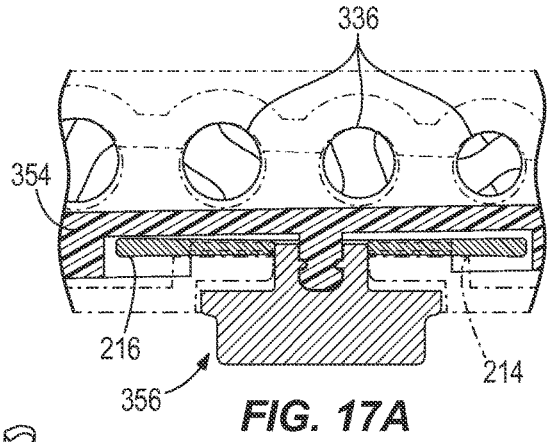
FIG. 17A is an enlarged cross-sectional view taken along section line 17A-17A of FIG. 16.
Figure 16:
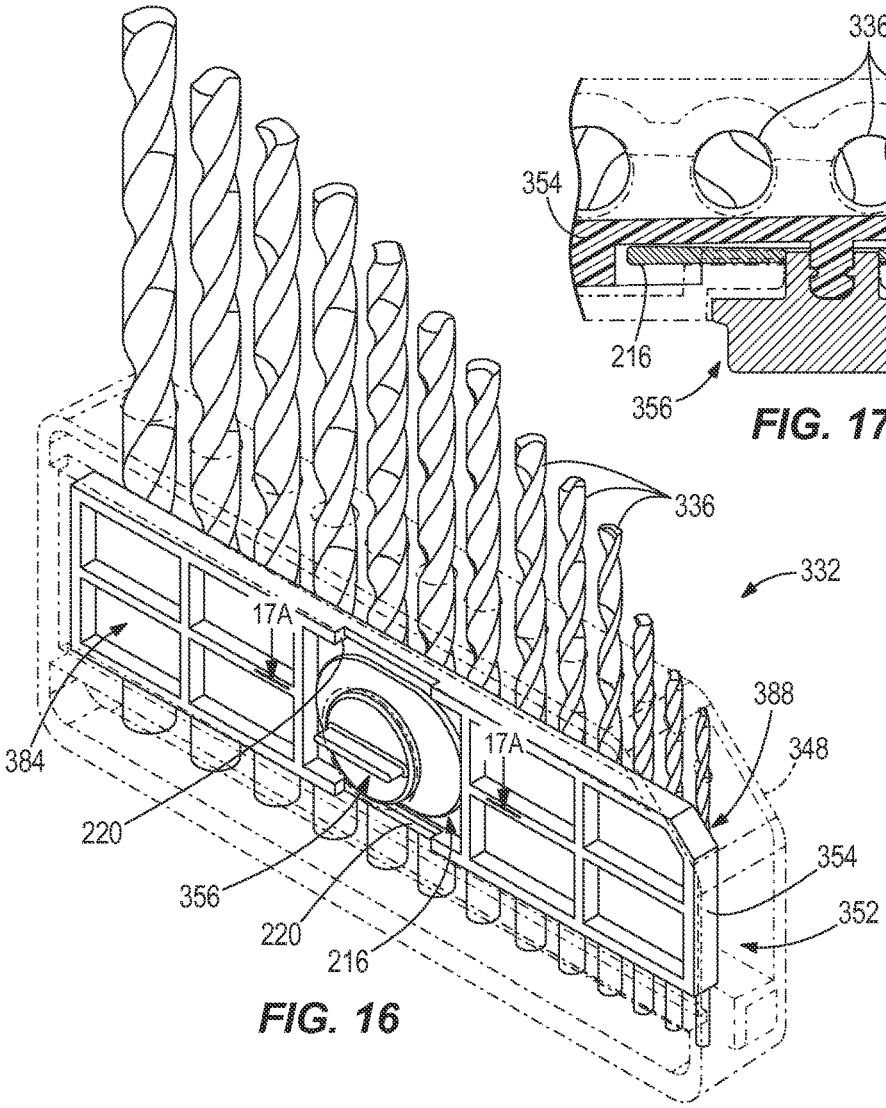
FIG. 16 is a perspective view of the tool bit retainer of FIG. 11 including the plurality of drill bits and the locking mechanism in a second position.
Figure 17:
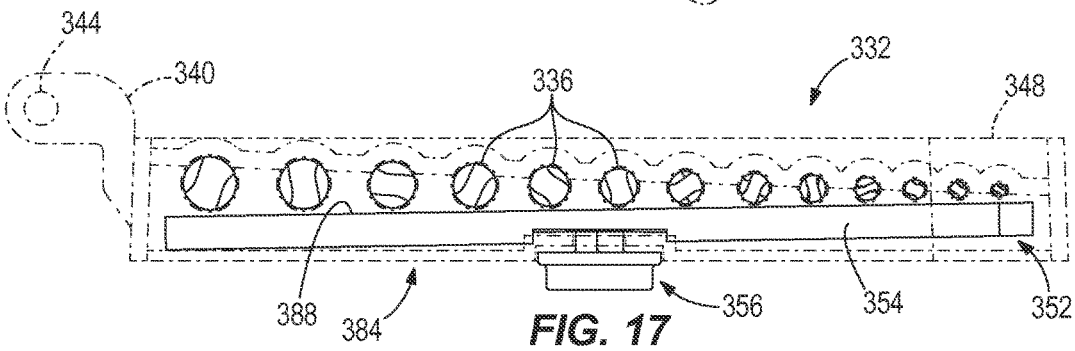
FIG. 17 is a top, partially transparent view of the tool bit retainer of FIG. 11 with the locking mechanism in the second position.
Figure 18:
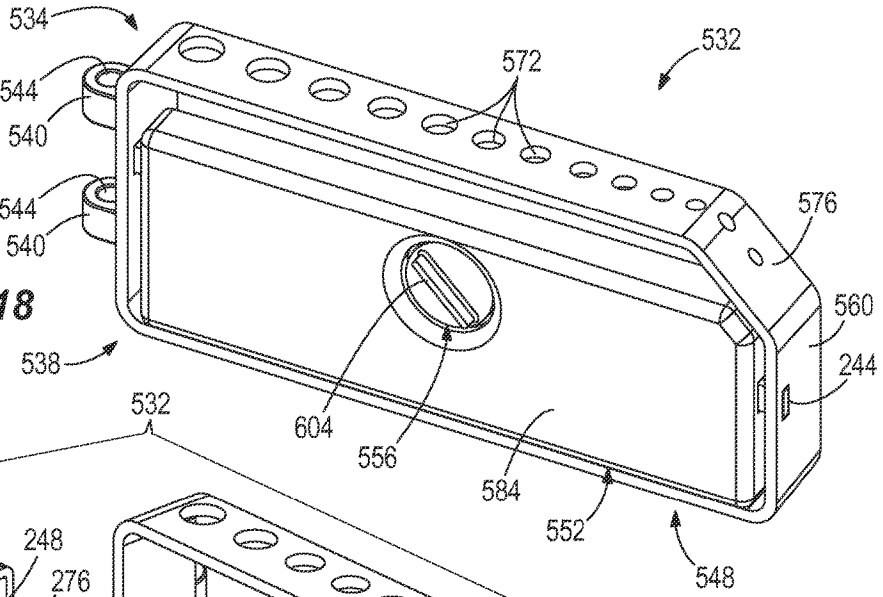
FIG. 18 is a perspective view of a tool bit retainer for use with the tool bit case according to another embodiment of the invention.

In operation, the locking mechanism 352 is movable between a first position (FIGS. 14-15A) and a second position (FIG. 16-17A). In the first, or storage, position, the actuator 356 is rotated so the edges 240 of the spacer 216 are received within the recesses 220. That is, the spacer 216 is oriented in a vertical orientation, as viewed in FIG. 14. As such, the thickness T of the spacer 216 is sized such that the spacer 216 abuts (e.g., pushes against) the plate 354 to force the engaging surface 388 of the plate 354 into engagement with the drill bits 336. The recesses 220 in the plate 354 inhibit the spacer 216 from freely moving (e.g., sliding or rotating) out of the first position. In addition, the recesses 220 provide positive, tactile feedback for a user when the spacer 216 is moved to the first position.

In the second, or removable, position, the actuator 356 is rotated so the edges 240 of the spacer 216 disengage from (e.g., move out of) the recesses 220. That is, the spacer 216 is oriented in a horizontal orientation, as viewed in FIG. 16. The actuator 356 needs to be rotated with sufficient force by a user so that the edges 240 of the spacer 216 temporarily deflect to clear the recesses 220. When in the second position, the spacer 216 can move axially relative to the plate 354 and the housing 348 so the engaging surface 388 of the plate 354 releases the drill bits 336.

FIGS. 18-24 illustrate a tool bit retainer 532 according to yet another embodiment of the invention. The tool bit retainer 532 is similar to the tool bit retainer 132 discussed above; therefore, like components have been given like reference numbers plus 400. Only differences between the tool bit retainers 132 and 532 will be discussed in detail below. In addition, components or features described with respect to only one or some of the embodiments described herein are equally applicable to any other embodiments described herein.

The tool bit retainer 532 includes a housing 548, a locking mechanism 552, and an actuator 556. The housing 548 is defined by a frame 560 and includes an upper surface 534 and a lower surface 538. The housing 548 includes a chamfered corner 576 and supports drill bits 536 via drill bit apertures 572 and cavities 580. The frame 560 includes apertures 244 located between the upper surface 534 and the lower surface 538 on opposite sides of the housing 548. In particular, one aperture 244 is located adjacent the support structure 540, and the other aperture 244 is located adjacent the corner 576. The illustrated apertures 244 are formed as rectangular apertures.

Figure 19:
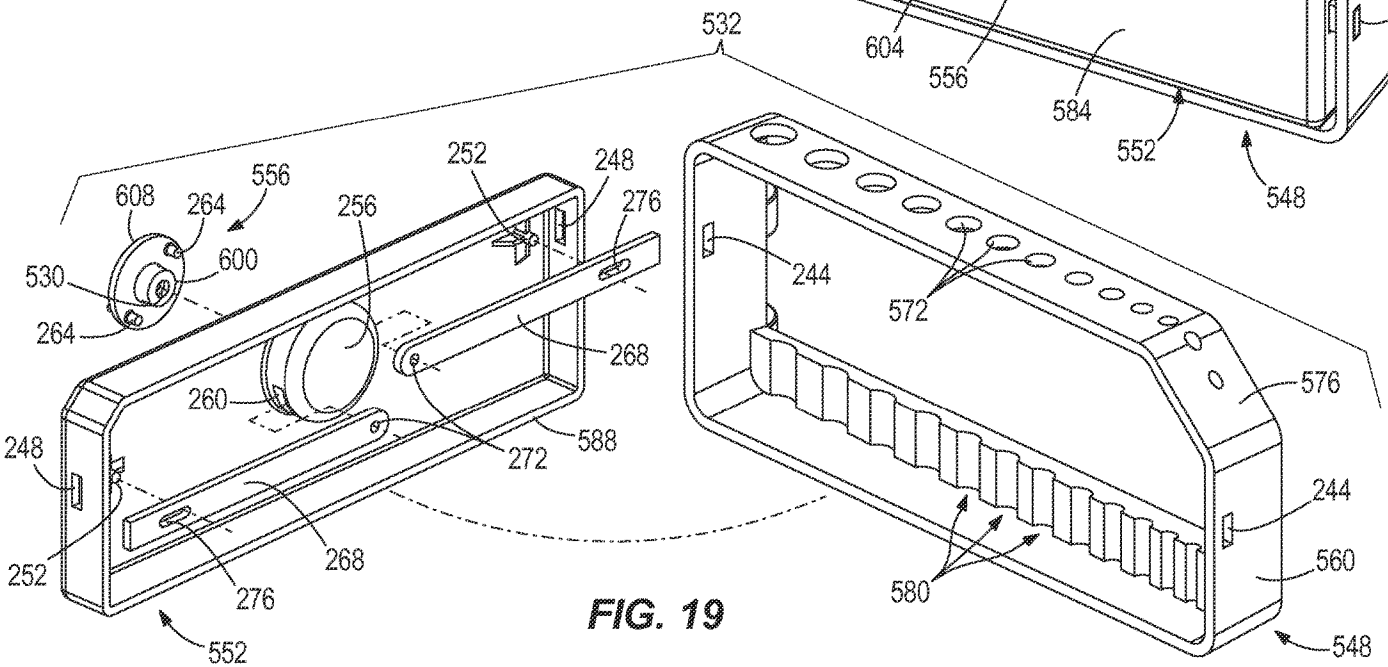
FIG. 19 is a rear exploded perspective view of the tool bit retainer of FIG. 18.
Figure 20:
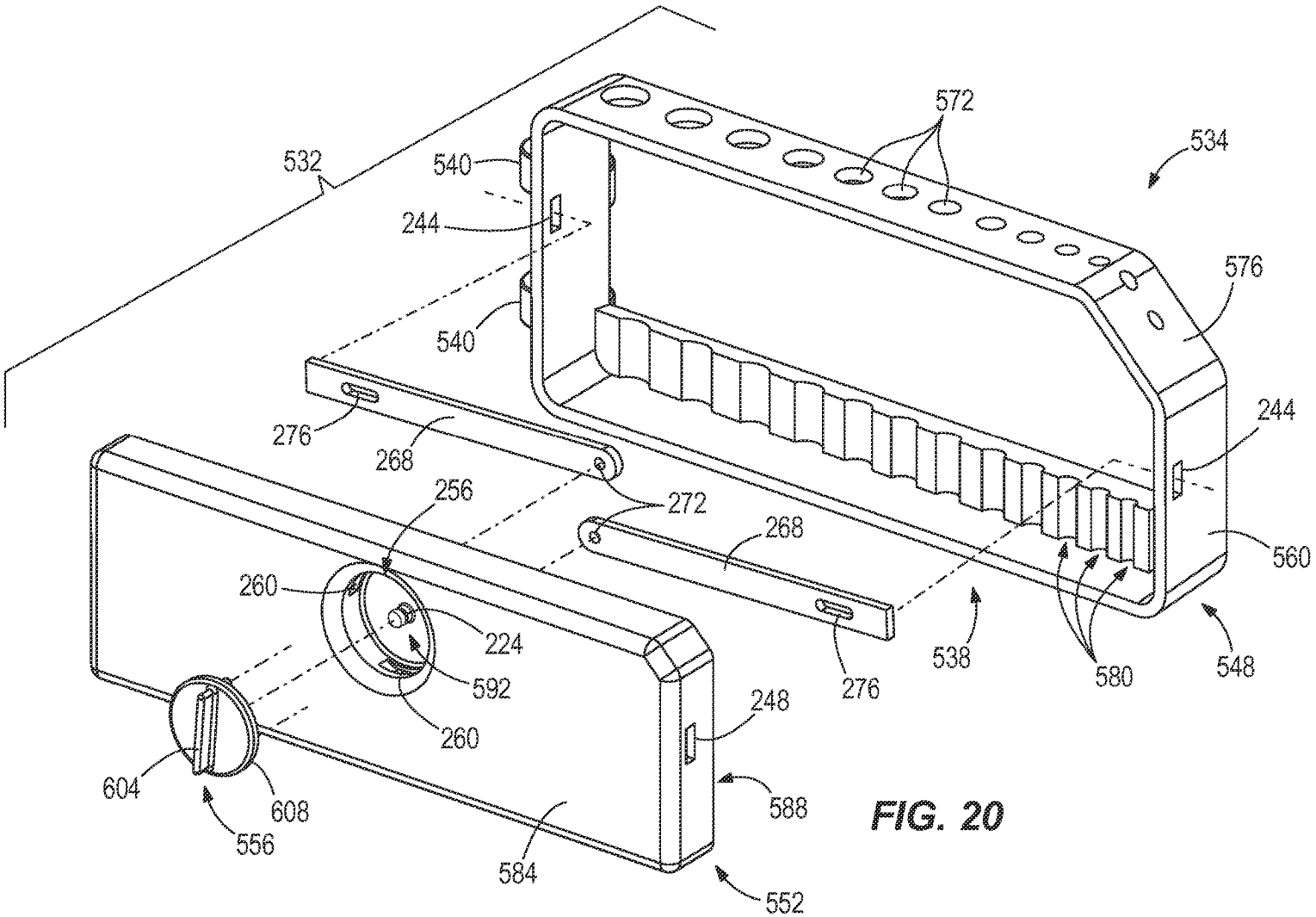
FIG. 20 is a front exploded perspective view of the tool bit retainer of FIG. 18.
Figure 21:
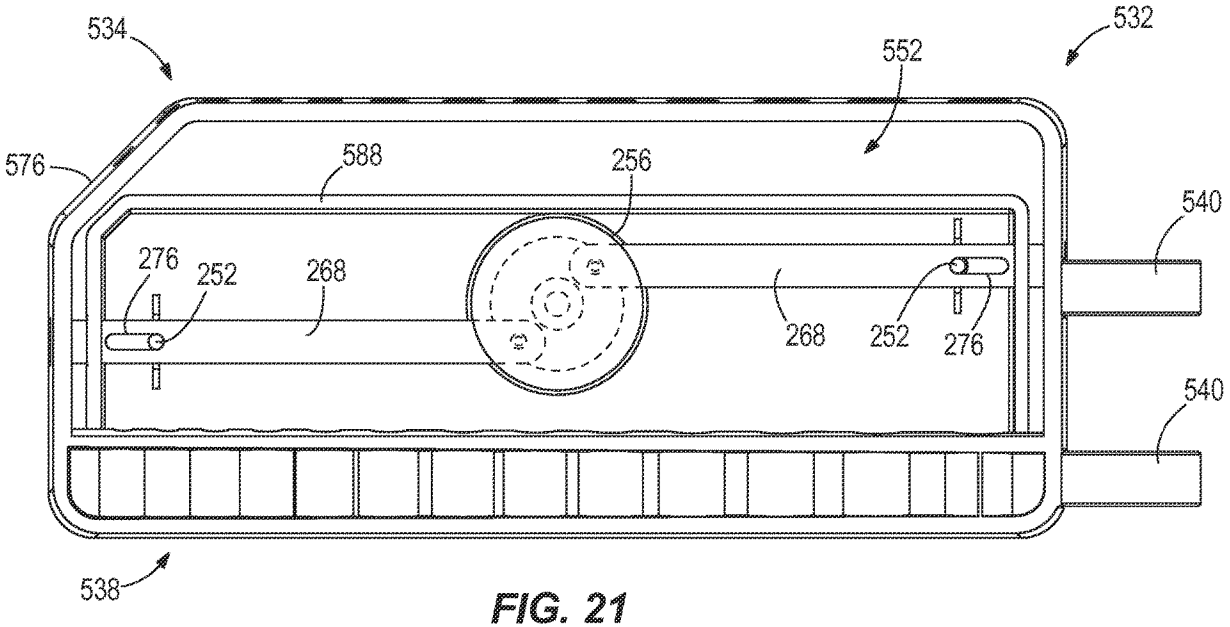
FIG. 21 is a rear view of the tool bit retainer of FIG. 18 with a locking mechanism in a first position.
Figure 22:
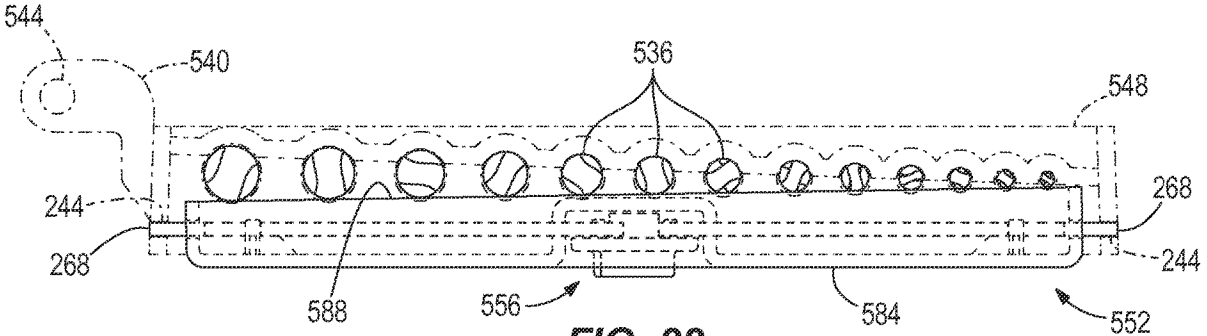
FIG. 22 is a top, partially transparent view of the tool bit retainer of FIG. 18 with a locking mechanism in the first position.

As shown in FIGS. 19 and 20, the locking mechanism 552 includes a front portion 584 and an engaging surface 588. In the illustrated embodiment, the engaging surface 588 is defined as the thickness of the periphery of the locking mechanism 552. In addition, the engaging surface 588 is orientated at an oblique angle β (FIG. 24) relative to the front portion 584. The illustrated angle β is similar to the angle θ of the plate 154 (FIG. 8) in that the engaging surface 588 is orientated at the angle β to facilitate engaging multiple drill bits 536 of different diameters. Located between the front portion 584 and the engaging surface 588 are apertures 248 and support pins 252 (FIG. 19). The illustrated apertures 248 are formed as rectangular apertures. Each support pin 252 corresponds to one of the apertures 248. In the illustrated embodiment, the locking mechanism 552 includes two pairs of support pins 252 and apertures 248; however, in other embodiments, the locking mechanism 552 may include more than two pairs.

Furthermore, the locking mechanism 552 includes a hub 256 having openings 260 and a protrusion 592 with a groove 224 (FIG. 20). Each opening 260 corresponds to a respective support pin 252 and aperture 248. In the illustrated embodiment, the hub 256 includes two openings 260 generally spaced 180 degrees apart. In other embodiments, the hub 256 may include more than two openings 260. For example, the hub 256 may include four openings 260 generally spaced 90 degrees apart.

The locking mechanism 552 also includes two bars 268. Each bar 268 has an aperture 272 and a slot 276 located on opposite ends of the bar 268 from each other. The bars 268 extend from the hub 256 toward a respective aperture 248. The illustrated bars 268 are configured (i.e., shaped and sized) to fit through the apertures 248 in the locking mechanism 552 and into the apertures 244 in the housing 548.

The actuator 556 includes a projection 600 and a rib 604 coupled to a base 608. Protrusions 264 extend from the base 608 away from the rib 604 and are spaced generally 180 degrees from each other. The projections 264 fit within the apertures 272 in the bars 268 to couple the bars 268 to the actuator 556. In addition, the projection 600 includes an annular groove 530 (FIG. 19). Otherwise, the actuator 556 is similar to the actuator 356 as illustrated in FIG. 13.

During assembly of the locking mechanism 552, portions of the bars 268 adjacent the apertures 272 are received within a respective opening 260 of the hub 256. Other portions of the bars 268 adjacent the slots 276 are received within the respective apertures 248. Consequently, each support pin 252 is received within a respective slot 276 of each bar 268. The projection 600 of the actuator 556 is attached to the protrusion 592 of the hub 256, and each protrusion 264 of the actuator 556 is received within a respective aperture 272 of the bars 268. Then, the locking mechanism 552 is received within the housing 548 such that a portion of each bar 268 aligns with a respective aperture 244. In addition, the locking mechanism 552 is selectively removable from the housing 548.

Figure 23:
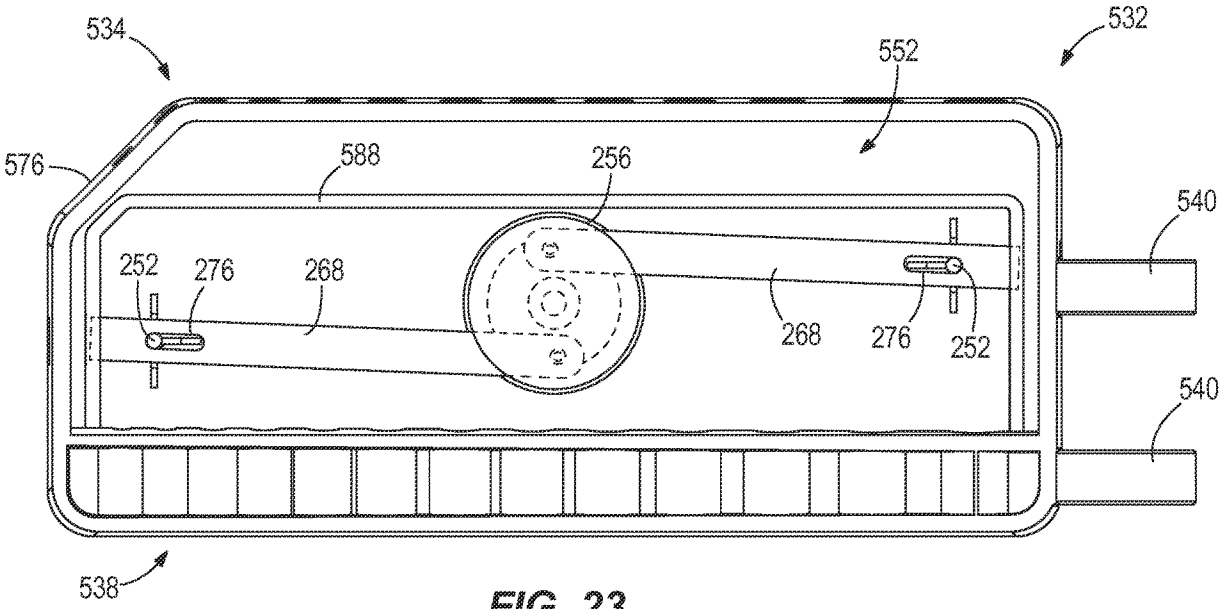
FIG. 23 is a rear view of the tool bit retainer of FIG. 18 with the locking mechanism in a second position.
Figure 24:
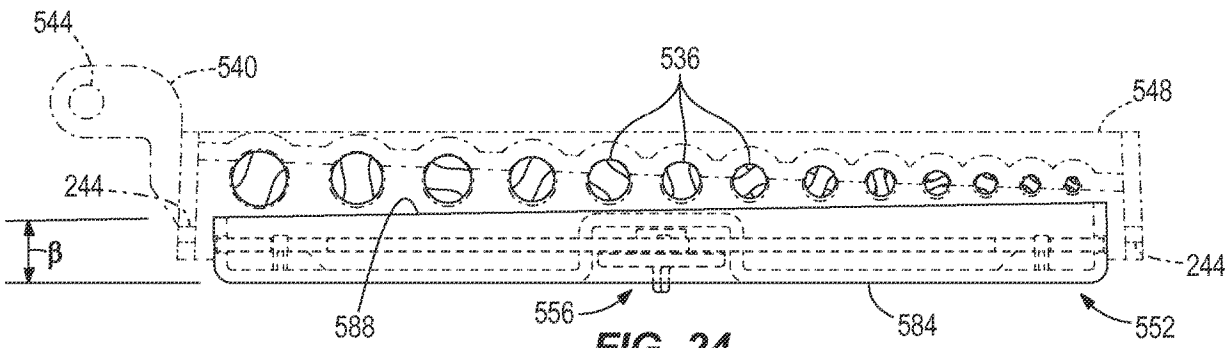
FIG. 24 is a top, partially transparent view of the tool bit retainer of FIG. 18 with the locking mechanism in the second position.
Figure 25:
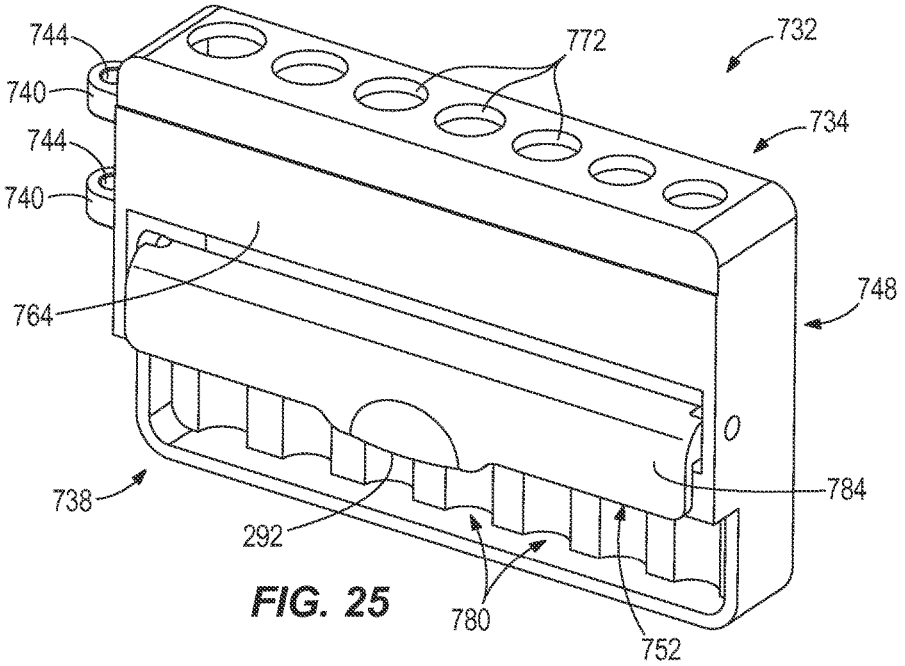
FIG. 25 is a perspective view of a tool bit retainer for use with the tool bit case according to another embodiment of the invention.
Figure 26:
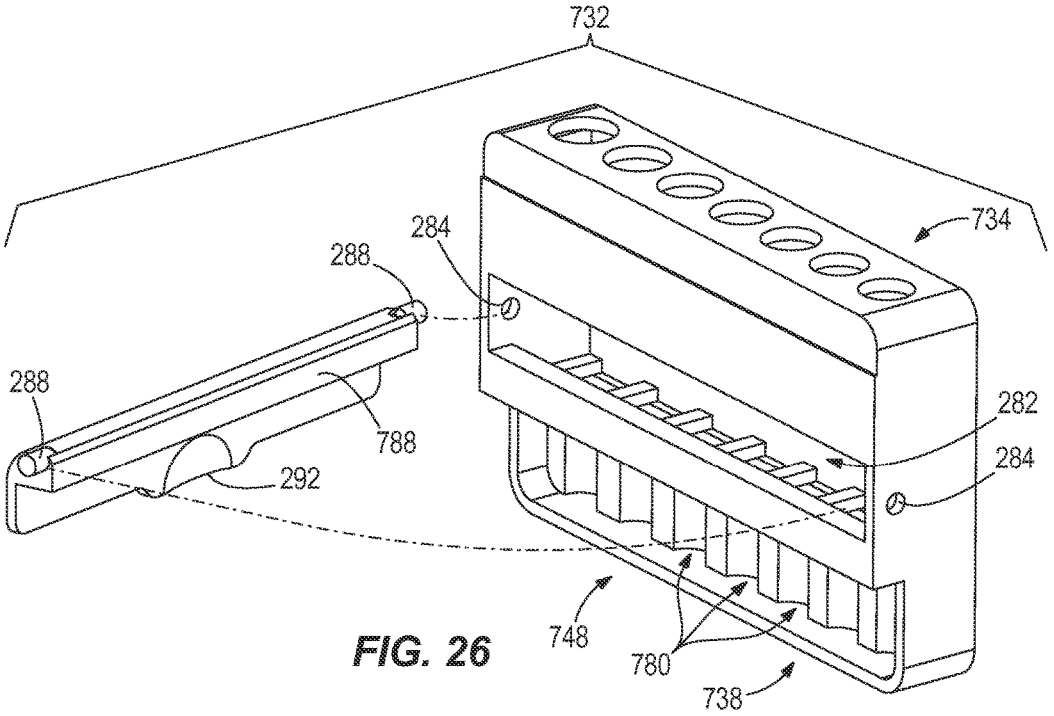
FIG. 26 is an exploded perspective view of the tool bit retainer of FIG. 25.
Figure 27:
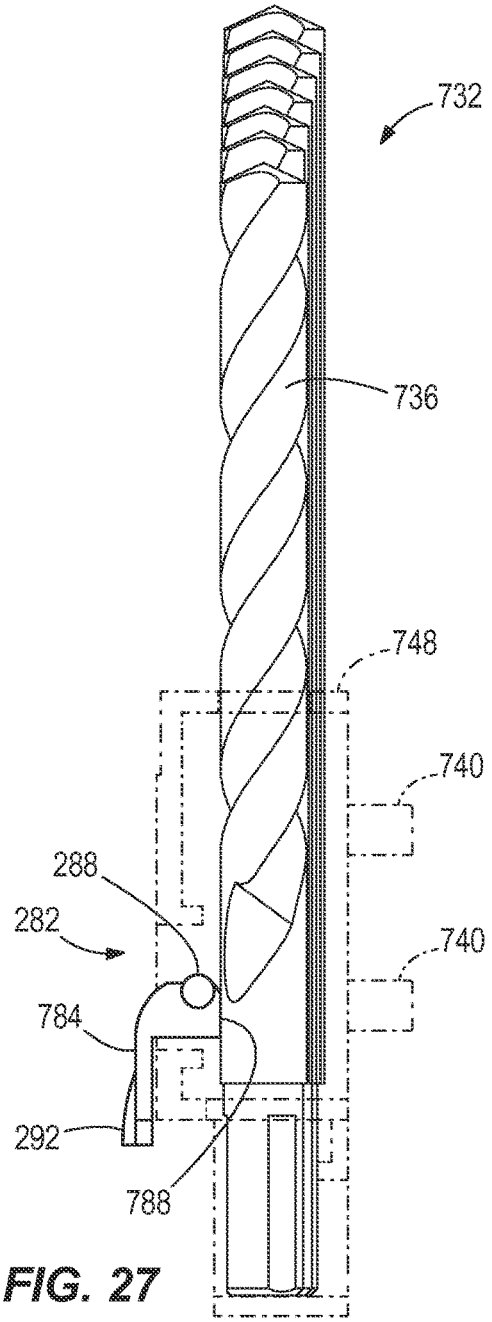
FIG. 27 is a side, partially transparent view of the tool bit retainer of FIG. 25 with a locking mechanism in a first position.

In operation, the locking mechanism 552 is movable between a first position (FIGS. 21 and 22) and a second position (FIGS. 23 and 24). In the first, or storage, position, the protrusions 264 of the actuator 556 are rotated such that the bars 268 substantially translate, or slide, into engagement with the apertures 244. When in this position, the engaging surface 588 abuts (i.e., directly contacts) the drill bits 536, inhibiting removal of the drill bits 536 from the retainer 532. In addition, the locking mechanism 552 is retained within the frame 560.

In the second, or removable, position, the protrusions 264 of the actuator 556 are rotated oppositely compared to the storage position such that the bars 268 substantially translate, or slide, out of engagement with the apertures 244. When in this position, the locking mechanism 552 can be moved away from the drill bits 536 and the housing 548. As such, the engaging surface 588 releases the drill bits 536.

FIGS. 25-28 illustrate a tool bit retainer 732 according to still yet another embodiment of the invention. The tool bit retainer 732 is similar to the tool bit retainer 132 discussed above; therefore, like components have been given like reference numbers plus 600. Only differences between the tool bit retainers 132 and 732 will be discussed in detail below. In addition, components or features described with respect to only one or some of the embodiments described herein are equally applicable to any other embodiments described herein.

The tool bit retainer 732 includes a housing 748 and a locking mechanism 752. The housing 748 includes an upper surface 734, a lower surface 738, and a front face 764 having a cavity 282. The housing 748 supports drill bits 736 via drill bit apertures 772 and cavities 780. Apertures 284 are located at opposing sides of the cavity 282. In some embodiments, the housing 748 may include a chamfered corner similar to the corner 176 of the bit retainer 132 (FIG. 6).

The locking mechanism 752 includes a front portion 784, an engaging surface 788, and pins 288. The pins 288 are located between the front portion 784 and the engaging surface 788 and extend in opposite directions relative to each other. In addition, the front portion 784 includes an indentation 292 located between the pins 288. The illustrated indentation 292 forms an actuator on the locking mechanism 752, facilitating operation (e.g., engaging and moving) of the locking mechanism 752 by a user.

During assembly of the tool bit retainer 732, the pins 288 of the locking mechanism 752 are received within the apertures 284 of the housing 748 such that the locking mechanism 752 is pivotable relative to the housing 748.

Figure 28:
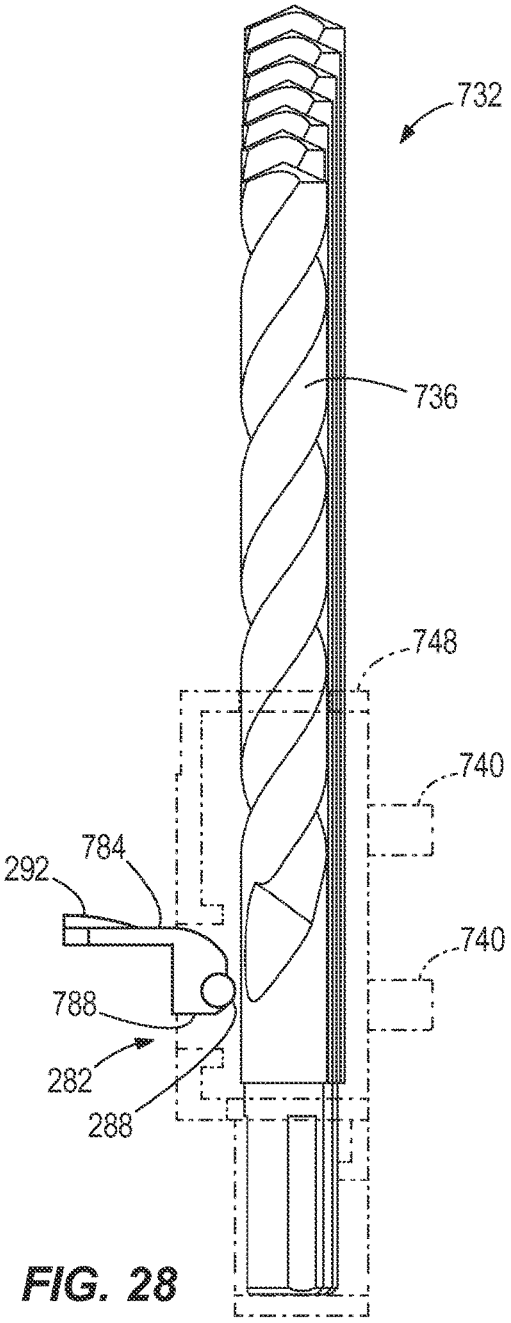
FIG. 28 is a side, partially transparent view of the tool bit retainer of FIG. 25 with a locking mechanism in a second position.

In operation, the locking mechanism 752 is movable between a first position (FIG. 27) and a second position (FIG. 28). In the first, or storage, the locking mechanism 752 is rotated about the pins 288 (e.g., downwardly in FIG. 27 and towards the cavities 780) via operator engagement with the indentation 292. When in this position, the engaging surface 788 abuts (e.g., directly contacts) the drill bits 736, thereby inhibiting removal of the drill bits 736 from the housing 748.

In the second, or removable, position, the locking mechanism 752 is rotated about the pins 288 (e.g., upwardly in FIG. 28 and towards the drill bit apertures 772) via operator engagement with the indentation 292. When in this position, the engaging surface 788 disengages (e.g., moves away from) the drill bits 736, allowing removal of the drill bits 736 from the housing 748.

In some embodiments, the housing 748 and/or the locking mechanism 752 may include a detent mechanism (e.g., a protrusion that is selectively received in a recess). In such embodiments, the detent mechanism can releasably secure the locking mechanism in the first position, in the second position, or in both positions. The detent mechanism would thereby inhibit the locking mechanism from freely moving between the first and second positions.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A tool bit case comprising:

a housing; and a tool bit retainer pivotally coupled to the housing, the tool bit retainer including a retainer housing including an upper surface, a lower surface, a front wall having a cavity, a rear wall, and a plurality of tool bit apertures formed in the upper surface between the front and rear walls, the plurality of tool bit apertures configured to receive a plurality of tool bits, and a locking mechanism moveably coupled to the retainer housing and including an engaging surface located at least partially within the cavity between the upper and lower surfaces of the retainer housing, the locking mechanism also including an actuator operable to move the engaging surface between a first position, in which the engaging surface engages the plurality of tool bits and presses the plurality of tool bits against the rear wall to inhibit removal of the plurality of tool bits from the retainer housing, and a second position, in which the engaging surface disengages the plurality of tool bits to allow removal of the plurality of tool bits from the retainer housing.

2. The tool bit case of claim 1, wherein the actuator is rotatable relative to the engaging surface, wherein the actuator is operable to linearly translate the engaging surface between the first position and the second position.

3. The tool bit case of claim 2, wherein the locking mechanism includes a locking plate having the engaging surface, and wherein the actuator threadably engages the locking plate.

4. The tool bit case of claim 2, wherein the tool bit retainer includes a spacer located between the actuator and a locking plate of the locking mechanism, wherein the spacer is rotatably fixed to the actuator and engages the locking plate in the first position.

5. The tool bit case of claim 1, wherein the tool bit retainer includes a bar coupled to the actuator, wherein the bar engages the retainer housing in the first position and disengages the retainer housing in the second position.

6. The tool bit case of claim 5, wherein as the actuator rotates, the bar substantially linearly translates relative to the retainer housing.

7. The tool bit case of claim 1, wherein the locking mechanism pivots between the first position and the second position.

8. The tool bit case of claim 1, wherein the locking mechanism includes a protrusion, and wherein the engaging surface is formed at an oblique angle relative to the protrusion.

9. The tool bit case of claim 1, wherein the retainer housing includes a plurality of cavities located away from the plurality of tool bit apertures and configured to receive the plurality of tool bits, wherein each cavity of the plurality of cavities aligns with a corresponding tool bit aperture, and wherein the locking mechanism is located generally between the plurality of tool bit apertures and the plurality of cavities.

10. The tool bit case of claim 1, wherein the plurality of tool bit apertures have different diameters configured to receive a plurality of different sized twist drill bits.

11. A tool bit case comprising:

a first housing member and a second housing member pivotally coupled together about an axis;

a plurality of tool bit retainers pivotally coupled between the first and the second housing members about the axis, each tool bit retainer including a retainer housing including an upper surface, a lower surface, a front wall, a rear wall, and a plurality of tool bit apertures formed in the upper surface between the front and rear walls, the plurality of tool bit apertures configured to receive a plurality of tool bits; and a locking mechanism moveably coupled to the retainer housing and including an engaging surface located between the upper and lower surfaces, the locking mechanism also including an actuator operable to move the engaging surface between a first position, in which the engaging surface engages the plurality of tool bits and presses the plurality of tool bits against the rear wall to inhibit removal of the plurality of tool bits from the retainer housing, and a second position, in which the engaging surface disengages the plurality of tool bits to allow removal of the plurality of tool bits from the retainer housing.

12. The tool bit case of claim 11, wherein the actuator is rotatable relative to the engaging surface, wherein the actuator is operable to linearly translate the engaging surface between the first position and the second position.

13. The tool bit case of claim 12, wherein the locking mechanism includes a locking plate having the engaging surface, and wherein the actuator threadably engages the locking plate.

14. The tool bit case of claim 12, wherein the locking mechanism includes a spacer located between the actuator and a locking plate of the locking mechanism, wherein the spacer is rotatably fixed to the actuator and engages the locking plate in the first position.

15. The tool bit case of claim 11, wherein the locking mechanism includes a bar coupled to the actuator, wherein the bar engages the retainer housing in the first position and disengages the retainer housing in the second position.

16. The tool bit case of claim 15, wherein as the actuator rotates, the bar substantially linearly translates relative to the retainer housing.

17. The tool bit case of claim 11, wherein the locking mechanism of each tool bit retainer pivots between the first position and the second position.

18. The tool bit case of claim 11, wherein the locking mechanism of each tool bit retainer includes a protrusion, and wherein the engaging surface is formed at an oblique angle relative to the protrusion.

19. The tool bit case of claim 11, wherein the retainer housing of each tool bit retainer includes a plurality of cavities located away from the plurality of tool bit apertures and configured to receive the plurality of tool bits, wherein each cavity aligns with a corresponding tool bit aperture, and wherein the locking mechanism of each tool bit retainer is located generally between the plurality of tool bit apertures and the plurality of cavities.

20. The tool bit case of claim 11, wherein the plurality of tool bit apertures of each tool bit retainer have different diameters configured to receive a plurality of different sized twist drill bits.

* * * * *